US005173634A

United States Patent [19]

Kane

[11] Patent Number: 5,173,634

[45] Date of Patent: Dec. 22, 1992

[54] CURRENT REGULATED FIELD-EMISSION DEVICE

[75] Inventor: Robert C. Kane, Woodstock, Ill.

[73] Assignee: Motorola, Inc., Schaumburg, Ill.

[21] Appl. No.: 621,199

[22] Filed: Nov. 30, 1990

[51] Int. Cl.[5] ..... H01J 19/24; H01J 1/30; H01J 19/38; H01J 9/02

[52] U.S. Cl. ..... 313/306; 313/309; 313/336; 313/355; 313/351; 315/58; 445/50; 445/51

[58] Field of Search ..... 313/306, 309, 336, 308, 313/355; 315/58, 169.1, 169.3; 445/35, 46, 49, 50, 51

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 445/52 |
| 3,810,025 | 5/1974 | Aihara et al. | 313/336 X |
| 3,812,559 | 5/1974 | Spindt et al. | 445/50 X |
| 4,721,885 | 1/1988 | Brodie | 313/576 |
| 4,827,177 | 5/1989 | Lee et al. | 313/306 |
| 4,874,981 | 10/1989 | Spindt | 313/309 |
| 4,956,574 | 9/1990 | Kane | 313/308 X |
| 4,990,766 | 2/1991 | Simms et al. | 313/336 X |
| 5,012,153 | 4/1991 | Atkinson et al. | 313/309 |

FOREIGN PATENT DOCUMENTS

| | | |
|---|---|---|
| 0172089 | 7/1985 | European Pat. Off. . |
| 2604823 | 10/1986 | France . |
| 855782 | 8/1981 | U.S.S.R. . |
| 2204991A | 11/1988 | United Kingdom . |

OTHER PUBLICATIONS

A Vacuum Field Effect Transistor Using Silicon Field Emitter Arrays, by Gray, IEDM; Dec. 1986.

Advanced Technology: flat cold-cathode CRTs, by Ivor Brodie, Information Display; Jan. 1989.

Field -Emitter Arrays Applied to Vacuum Flourescent Display, by Spindt et al. Jan. 1989 issue of IEEE Transactions on Electronic Devices.

Field Emission Cathode Array Development For High--Current Density Applications by Spindt et al. dated Aug. 1982 vol. 16 of Applications of Surface Science.

*Primary Examiner*—Donald J. Yusko
*Assistant Examiner*—Ashok Patel
*Attorney, Agent, or Firm*—Eugene A. Parsons

[57] ABSTRACT

A field emission device is set forth for providing a current-regulating and potential equilibrium function.

7 Claims, 5 Drawing Sheets

CURRENT REGULATED FIELD-EMISSION DEVICE

FIELD OF THE INVENTION

This invention relates generally to field emission devices.

BACKGROUND OF THE INVENTION

Non-thermionic field emission devices (FEDs) are known in the art. Typically, for example, a vertical field emission cathode array is constructed utilizing layers of insulator and conductor film on a substrate such that holes are made through the upper conductor and insulator to provide access to a lower conductor layer. Frequently the lower conductor layer is configured to form sharp protuberances having good field emission characteristics. The protuberances are utilized as electron emitter tips, forming a cathode. An upper conductive layer is generally utilized as a second electrode.

Fabrication of FEDs has, in general, led to non-uniform geometry of individual emitter tips in device arrays. Since electron emission is from the emitter tips, the non-uniform geometry of the individual emitter tips typically causes non-uniform emission of electrons and, hence, destruction of emitter tips that emit excess electrons. There is a need for a device and method that provides for minimizing non-uniform electron emission from emitter tips.

SUMMARY OF THE INVENTION

This need and others are substantially met through provision of a field emission device and a method for making a field emission device that substantially provides current regulation in a field emission device in accordance with the present invention. The method for making a field emission device and the field emission device are set forth, the field emission device substantially comprising at least: a substrate, a first electrode disposed on the substrate, a second electrode disposed distally with respect to the first electrode, and a third electrode disposed in the intervening space between the first electrode and the second electrode and conductively coupled to at least a first impedance element which at least first impedance element is conductively coupled to an at least first common circuit, such that emission of electrons from one of the first and second electrodes substantially results in third electrode regulation of electron emission from the electron-emitting electrode.

BRIEF DESCRIPTION OF A PREFERRED EMBODIMENT

Figure 1:
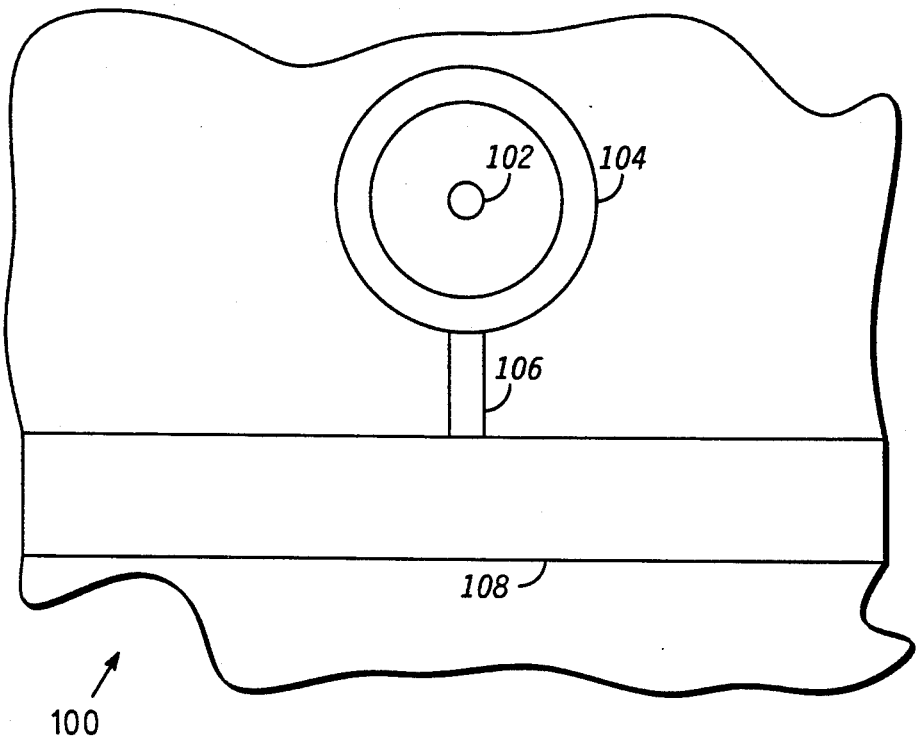
FIG. 1 illustrates a top plan view of one embodiment of a device in accordance with the present invention.

FIG. 1, numeral 100, depicts a top plan view of one embodiment of a device in accordance with the present invention, such that at least a third electrode (104) is electrically connected to at least a first impedance element (106) that is connected to a common gate line circuit (108). The device generally comprises at least a substrate, a first electrode disposed on the substrate, a second electrode not depicted disposed distally with respect to the first electrode, and a third electrode (104) disposed in the intervening space between the first electrode and the second electrode and conductively coupled to at least a first impedance element (106) which at least first impedance element (106) is conductively coupled to the at least first common gate line circuit (108), such that emission of electrons from one of the first and second electrodes described below, results in third electrode regulation of electron emission from the electron-emitting electrode. The at least third electrode (104) acts as a gate extraction electrode and as a detector electrode for current regulation. In the role of gate extraction electrode, the at least third electrode (104) applies a potential of appropriate polarity and magnitude with respect to a first electrode (102) such that electron emission is induced from the at least first electrode (102) as a result of an enhanced electric field substantially at a tip of the at least first electrode (102), which electric field is induced by the appropriate potential at the at least third electrode (104). In the role of detector electrode for current regulation, the at least third electrode (104) will collect at least a prescribed portion of any electrons emitted from the at least first electrode (102). Third electrode (104) proximity to the first electrode (102) is selectively determined with respect to a predetermined selected desired detector electrode current for a selected FED implementation of the present invention. For example, as the distance between the at least third electrode (104) and the at least first electrode (102) is decreased (i.e., as the inner diameter of the at least third electrode (104) is decreased), the proportion of any emitted electrons collected at the at least third electrode (104) will increase.

Placement of the at least first impedance element (106) in series with at least the third electrode (104) that functions as a first detector electrode results in a proportional voltage drop at the third electrode (104) as more electrons are emitted from a tip of at least the first emitter electrode (102) that functions as an emitter electrode. An at least second electrode, not illustrated, distally disposed with respect to the first electrode (102) functions as an anode to collect at least some of any emitted electrons. The proportional voltage drop is caused by collection of some emitted electrons at the third electrode (104), resulting in a detector current. This detector current effectively reduces maximum zero detector current voltage of the at least third electrode (104). The voltage reduction effectively reduces a potential difference between the at least third electrode (104) and a tip of the at least first emitter electrode (102), thereby reducing the electric field at the tip surface of the at least first emitter electrode (102) and establishing an independent equilibrium and current limitation for each at least first emitter electrode (102). In one embodiment, the at least first, second and third electrodes are further placed substantially co-planar with respect to each other. In another embodiment, the first electrode, the second electrode, and the third electrode are located substantially in a non-coplanar manner such that the first electrode is located substantially on a substrate, the third electrode is substantially above the first electrode, and the second electrode is substantially above the third electrode. Clearly, where the at least first electrode functions as an emitter electrode for emission of electrons, the at least second electrode functions as an anode electrode for collecting at least some of the electrons emitted by the emitter electrode, and vice-versa.

Figure 2:
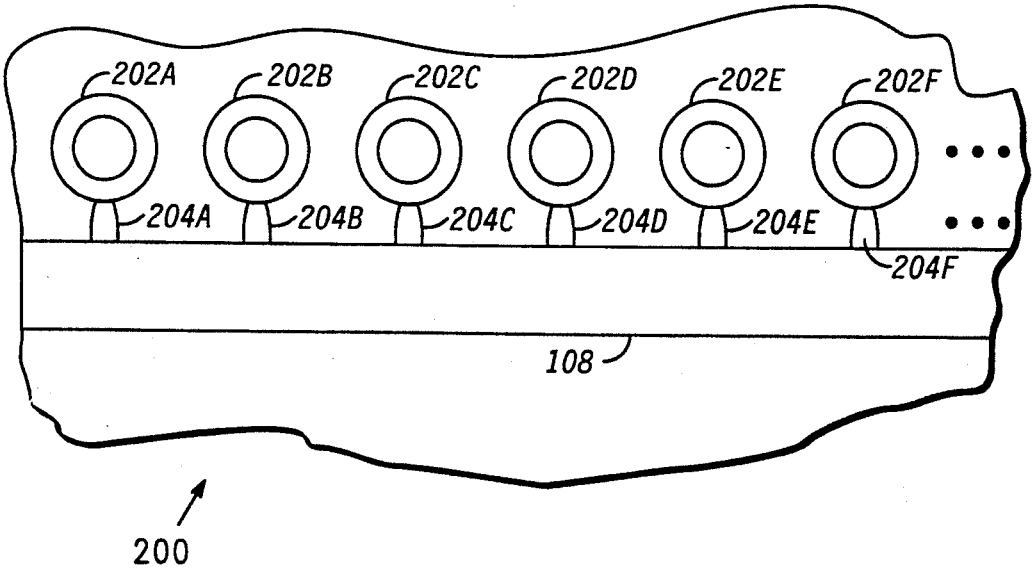
FIG. 2 illustrates a top plan view of one embodiment of a plurality of detector impedance elements constructed in accordance with the present invention.

FIG. 2, numeral 200, illustrates a top plan view of one embodiment of a plurality of detector electrodes (202A–202F), which detector electrodes (202A–202F) also function as gate extraction electrodes in a device having a plurality of FEDs constructed in accordance with the present invention. A plurality of detector electrodes (202A–202F, . . . ) are each serially electrically connected through impedance elements (204A–204F, . . . ) to a common gate line circuit (108) such that a plurality of FEDs utilizing such a plurality of detector electrodes (202A–202F, . . . ) are independently current regulated.

Figure 3:
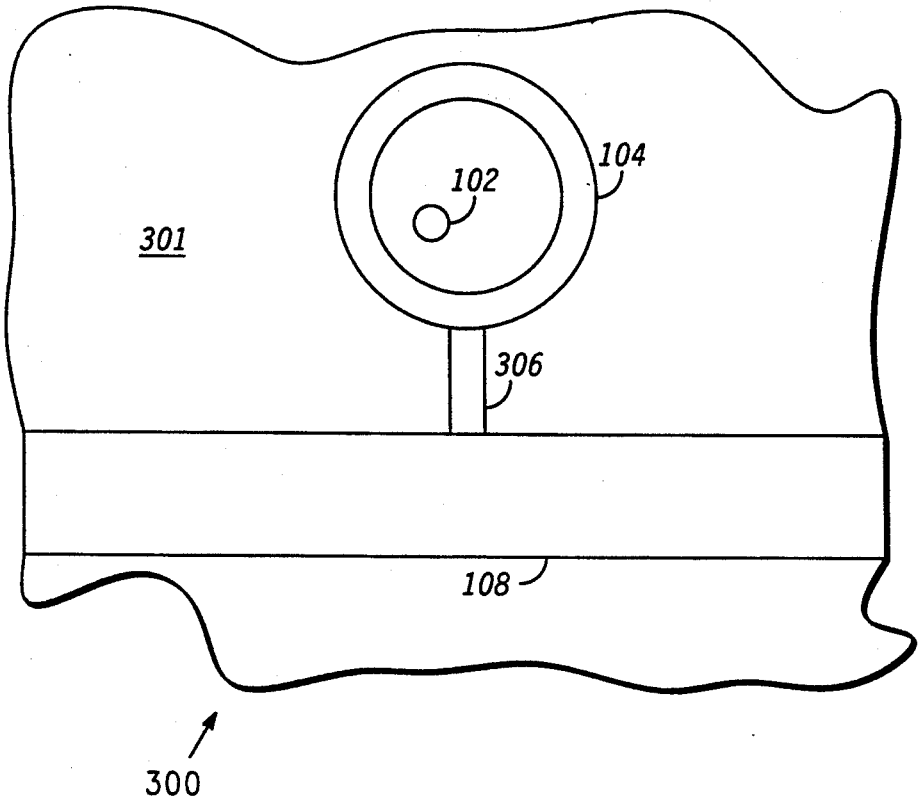
FIG. 3 illustrates a top plan view of another embodiment of a device in accordance with the present invention, wherein an FED emitter electrode tip is skewed.

FIG. 3, numeral 300, illustrates a top plan view of another embodiment of a device in accordance with the present invention, wherein an FED emitter electrode tip (302) disposed on a substrate (301) and is formed non-concentrically with respect to the at least third electrode (104). A third electrode (104) causes greater electron emission by non-concentric FED emitter tip electrode (302) in comparison with an FED emitter electrode that is concentric, a condition that could lead to excess electron emission of the non-concentric FED emitter tip electrode (302) where no current limitation existed. The present invention provides an impedance element (306), connected serially between the at least third electrode (104) and a common gate line circuit (108), that allows for current regulation of the FED with the non-concentric emitter electrode tip (302), causing a voltage potential equilibrium to exist between the detector electrode (104) and the FED nonconcentric emitter tip electrode (302), thereby preventing excess electron emission of the FED having the non-concentric emitter tip electrode (302).

Figure 4:
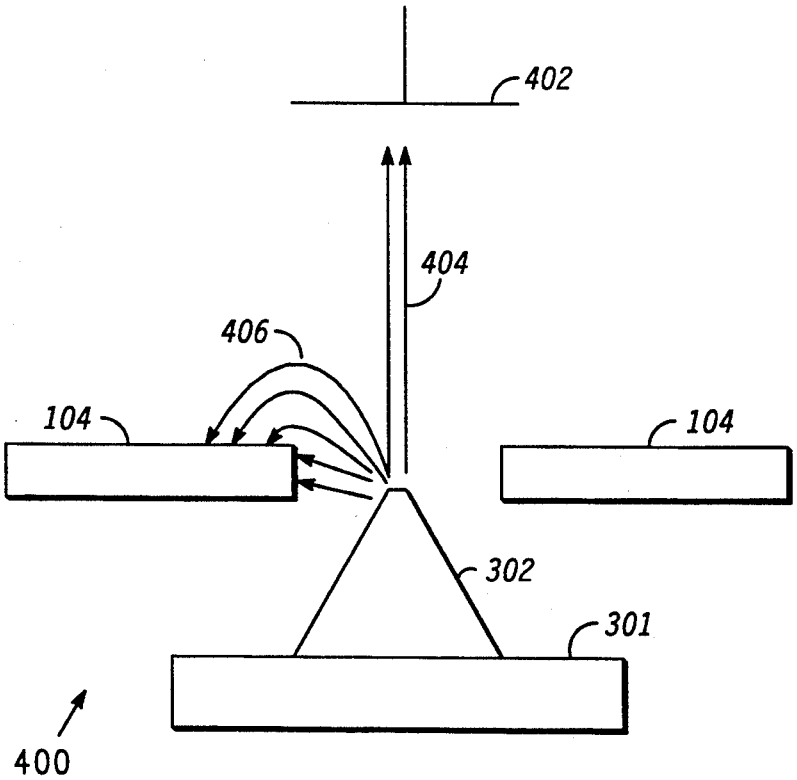
FIG. 4 illustrates a side elevational cross-sectional schematic view of an embodiment of an FED in accordance with the present invention, wherein electron emission in non-symmetrically directed.

FIG. 4, numeral 400, illustrates a side elevational cross-sectional schematic representation of the embodiment of the FED described previously with reference to FIG. 3 that includes a serially connected impedance element, not shown, operably coupled to the detector electrode (104). As shown, the non-concentric nonsymmetric construction results in an excess of emitted electrons, some of which emitted electrons (406) are collected at the at least third electrode (104). The remainder of the emitted electrons (404) are substantially collected at the at least second electrode (402), which electrode functions, in this instance, as an anode. The embodiment depicted demonstrates a non-optimum configuration which may result due to fabrication process tolerances and instabilities. FEDs of the prior art frequently suffered from catastrophic failure due to the incidence of excess current at the third electrode (104), corresponding to the gate extraction electrode. In the present invention, wherein a current regulation mechanism is provided by the at least one impedance element, previously described and not depicted in FIG. 4, and the at least third electrode (104) functions, at least in part, as a detector electrode, current regulation is effected, precluding the possibility of catastrophic device failure typically induced by fabrication inconsistency. FIG. 4 thus shows a schematic representation where an at least first electrode, functioning as an emitter electrode, is substantially an FED emitter eletrode tip (302) emitting electrons unsymmetrically such that some excess electron emission (406) is collected at the at least third electrode (104), a detector electrode for substantially regulating electron emission by the emitter electrode.

Figure 5:
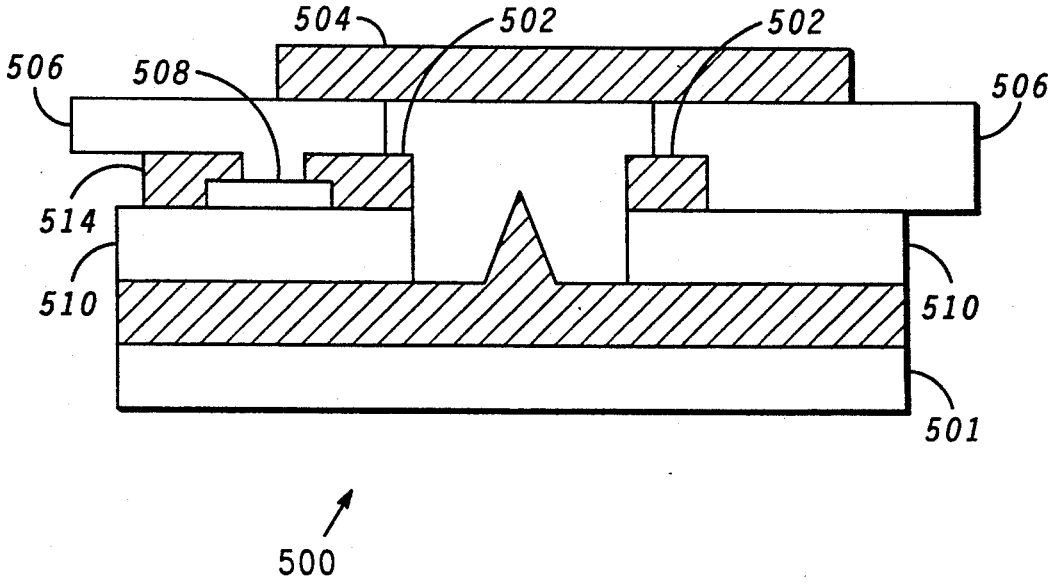
FIG. 5 illustrates a side elevational cross-sectional view of an embodiment of a device on accordance with the present invention, wherein a detector impedance element lies on an insulator layer.

FIG. 5, numeral 500, illustrates a side elevational cross-sectional view of an embodiment of a device in accordance with the present invention, wherein at least a first impedence element (508), electrically coupled in series with at least a third electrode (502) functioning in part as a detector electrode, lies ON an insulator (510) layer. An at least second electrode (504) functions as an anode electrode, and an at least first electrode (512) functions as an emitter electrode. In this embodiment electrode (512) is disposed on a substrate (501). Further, the insulator layer (510) and at least a second insulator layer (506) are selectably utilized to separate the at least three electrodes that function as previously described. A common gate circuit line (514) is provided to couple the FED detector circuit, comprising at least a first impedance element (508) and at least a third electrode (502), to external circuitry.

Figure 6:
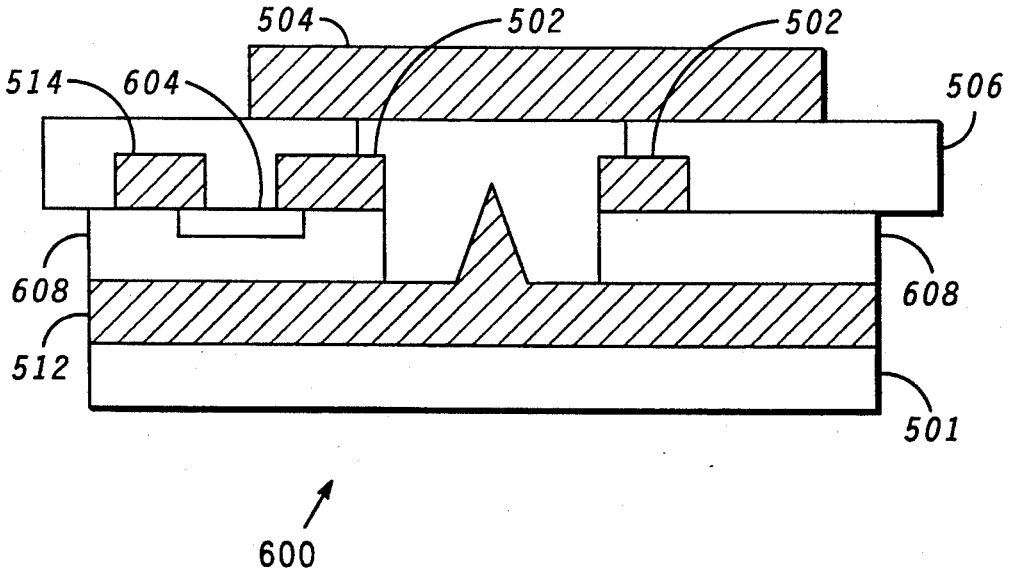
FIG. 6 illustrates a side elevational cross-sectional view of an embodiment of a device in accordance with the present invention, wherein a detector impedance element lies in an insulator layer.

FIG. 6, numeral 600, illustrates a side elevational cross-sectional view of an embodiment of a device in accordance with the present invention, wherein at least a first impedance element (604), electrically coupled in series with at least a third electrode (502) functioning in part as a detector electrode, lies IN an insulator (608) layer. An at least second electrode (504) functions as an anode electrode, and an at least first electrode (512) functions as an emitter electrode. In this embodiment electrode (512) is disposed on a substrate (501). Further, the insulator layer (608) and at least a second insulator layer (506) are selectably utilized to separate the at least three electrodes that function as previously described. As in FIG. 5, a common gate circuit line (514) is provided to couple the FED detector circuit, comprising at least a first impedance element (604) and at least a third electrode (502), to external circuitry.

Figure 7:
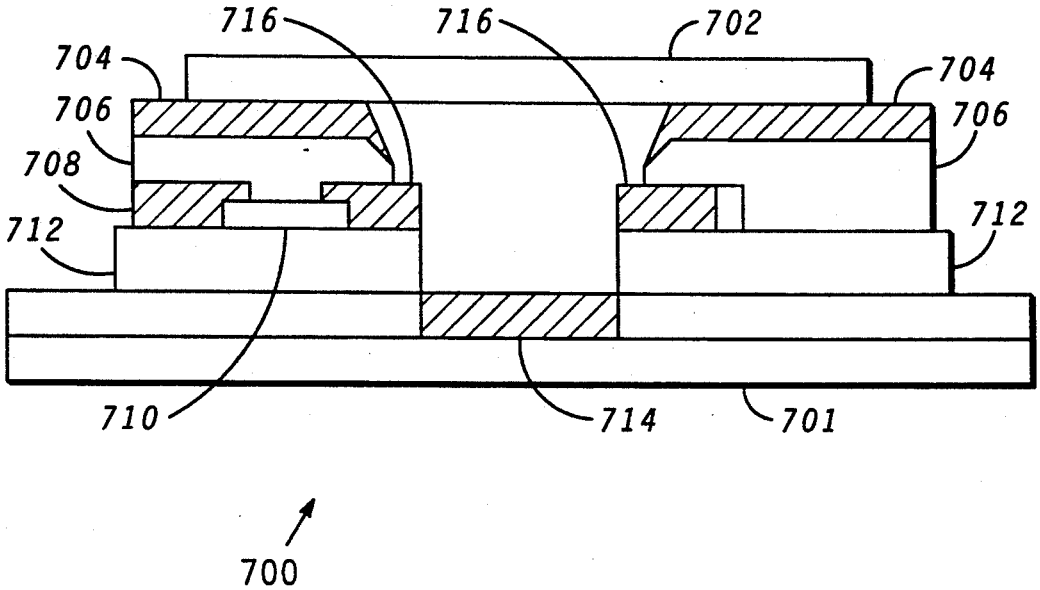
FIG. 7 illustrates a side elevational view of an embodiment of a device in accordance with the present invention, wherein a detector impedance element lies on an insulator layer.

FIG. 7, numeral 700, illustrates a side elevational cross-sectional view of an embodiment of a device in accordance with the present invention, wherein at least a first impedance element (710), serially electrically connected to at least a third electrode (716) that functions in part as a detector electrode, lies ON an insulator layer (712). The device further includes at least a second electrode (714) that functions as an anode electrode, and at least a first electrode (704) that functions as an emitter electrode. In this embodiment electrode (714) is disposed on a substrate (701). The insulator (712) and an at least second insulator layer (706) are selectably utilized, and a common gate circuit line (708) is employed as described above with reference to FIG. 6. FIG. 7 further depicts a third insulator layer (702) as an encapsulating layer which effectively provides a seal for the FED.

Figure 8:
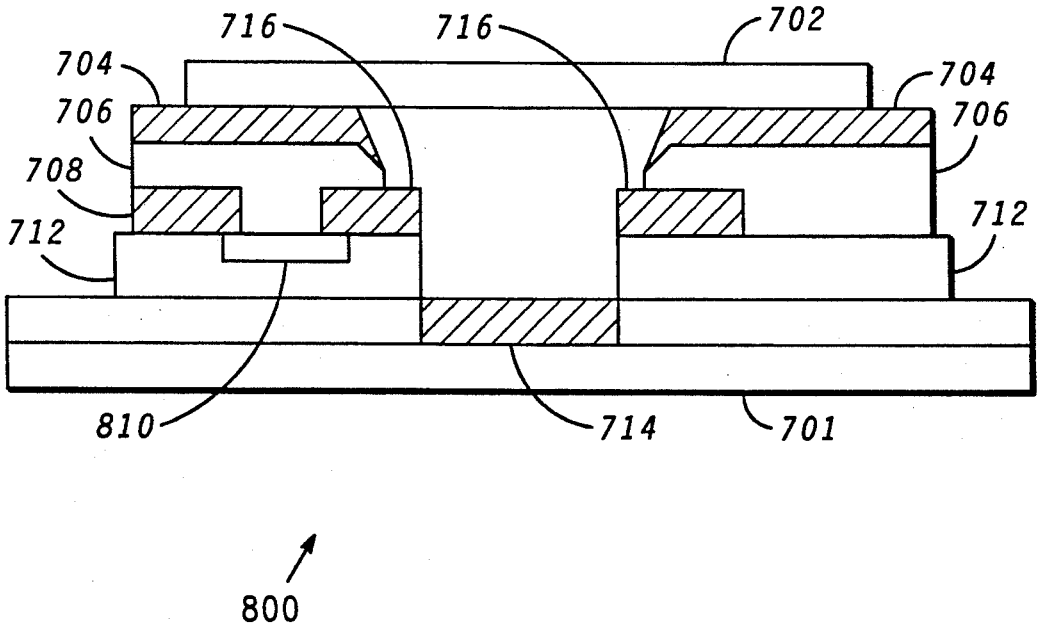
FIG. 8 illustrates a side elevational cross-sectional view of an embodiment of a device in accordance with the present invention, wherein a detector impedance element lies in an insulator layer.

FIG. 8, numeral 800, illustrates a side elevational cross-sectional view of an embodiment of a device in accordance with the present invention, wherein at least a first impedance element (810), serially electrically connected to at least a third electrode (716) that functions in part as a detector electrode, lies IN an insulator layer (712). The device further includes at least a second electrode (714) that functions as an anode electrode, and at least a first electrode (704) that functions as an emitter electrode. In this embodiment electrode (714) is disposed on a substrate (701). Again, the insulator portions (706, 712) are selectably utilized, and a common electrical gate circuit line (708) is employed as described above with reference to FIG. 6 FIG. 8 further depicts a third insulator layer (702) which insulator layer (702) functions as described previously with reference to FIG. 7.

Figure 9:
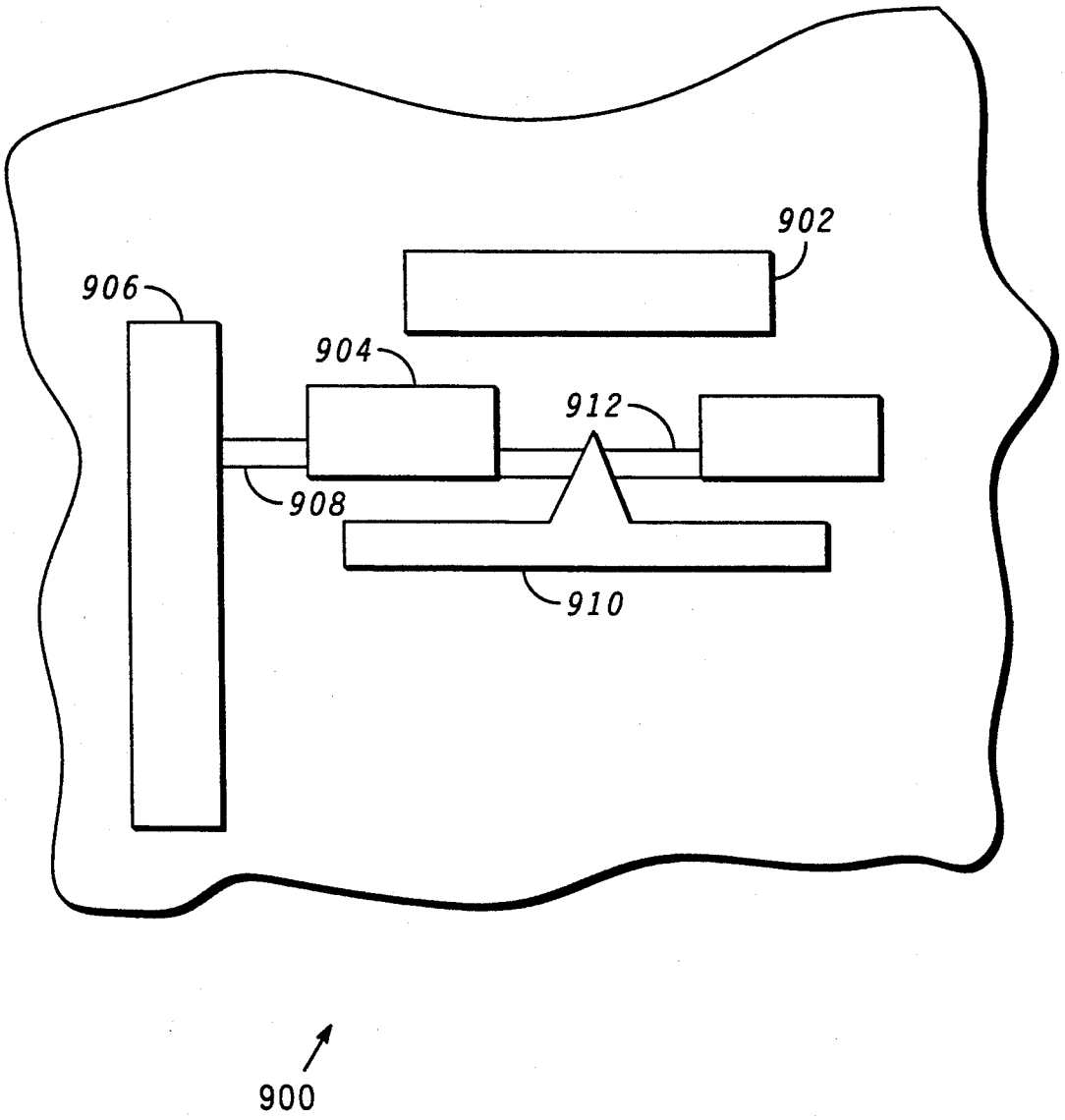
FIG. 9 illustrates a top view of an embodiment of a device in accordance with the present invention, wherein the FED is substantially planar.

FIG. 9 illustrates a top view of an embodiment of a device in accordance with the present invention, wherein the FED is substantially planar. An at least second electrode (902) functioning as an anode electrode is substantially disposed on at least a part of a surface of a substrate distally with respect to an at least first electrode (910) functioning as an emitter electrode. An at least third electrode (904) is disposed in the intervening region between the at least second electrode (902) and the at least first electrode (910), the at least third electrode (904) functioning in part as a detector electrode to adjustably induce and regulate electron flow between the at least first electrode (910) and the at least second electrode (902), and serially electrically connected by at least a first impedance element (908) to a common gate circuit line (906).

The various embodiments disclosed are manufactured by a method of forming a current-regulated field emission device which includes the steps of providing a substrate and forming a first electrode on the substrate which acts as an electron emitter or as an electron collector. A second electrode is formed distally with respect to the first electrode and a third electrode is formed and conductively coupled to at least a first impedance element on a first common gate line circuit. The third electrode acts in concert with the at least first impedance element to regulate electron emission by the emitter electrode.

The present invention provides a preferred FED construction suitable for radio frequency and microwave devices, low-power receiver front-end devices, peripheral circuit devices including isolators and switches, high speed computing devices, display products, television, and sensors, among others. The very small size of FEDs, together with the preferred FED construction of the present invention, makes such FEDs highly desirable for the above-described devices.

I claim:

1. A field emission device integrated onto a single substrate, comprising:

a first electrode disposed on the substrate;

a second electrode disposed distally with respect to the first electrode, such that one of the first electrode and the second electrode is formed to emit electrons and the other of the first electrode and the second electrode is designed to collect at least some of the emitted electrons;

a third electrode disposed in an intervening space between the first electrode and the second electrode;

a common gate line circuit; and an impedance element conductively coupled to the common gate line circuit and further conductively coupled to the third electrode, such that emission of electrons from the one of the first electrode and the second electrode results in regulation by the third electrode of electron emission from the one of the first electrode and the second electrode emitting the electrons.

2. A device as claimed in claim 1 wherein the first electrode, the second electrode, and the third electrode are substantially co-planar with respect to one another.

3. A field emission device having a common circuit and having a plurality of cells disposed on a substrate, each cell comprising:

a first electrode disposed on the substrate and operating as an electron source for emitting electrons;

a second electrode operating as a collector, the second electrode being disposed distally with respect to the first electrode for collecting at least some of any electrons emitted by the first electrode;

an impedance element in a common gate line circuit; and a third electrode disposed in an intervening region between the first electrode and the second electrode and being conductively coupled to the impedance element such that at least some of any electrons by the first electrode are collected at the third electrode, which in concert with the impedance element, provides current regulation of emitted electrons from the first electrode.

4. A device as claimed in claim 3 wherein the first electrode, the second electrode, and the third electrode are substantially co-planar with respect to one another.

5. A field emission device integrated onto a single substrate, comprising:

an emitter for emitting electrons;

an anode disposed distally with respect to the emitter for collecting at least some of the electrons emitted by the emitter;

a gate electrode disposed in an intervening space between the emitter and the anode;

a common gate line circuit; and an impedance element conductively coupled to the common gate line circuit and further conductively coupled to the gate electrode such that non-uniform emission of electrons from the emitter results in the collection of some emitted electrons by the gate electrode resulting in a detector current which effectively reduces any potential difference between the gate electrode and the emitter.

6. A method of forming a current-regulated field emission device on a single substrate comprising the steps of:

forming an electron emitter for emitting electrons;

forming an anode disposed distally with respect to the emitter for collecting at least some of the electrons emitted by the emitter;

forming an impedance element in a common gate line circuit; and forming a gate electrode disposed in an intervening space between the emitter and the anode, the gate electrode being conductively coupled to the impedance element, which gate electrode is further formed to operate in concert with the impedance element to regulate electron emission by the emitter.

7. A method as claimed in claim 6 whererin the emitter, the anode, and the gate electrode are substantially co-planar with respect to one another.

* * * * *

UNITED STATES PATENT AND TRADEMARK OFFICE

CERTIFICATE OF CORRECTION

PATENT NO. : 5,173,634

DATED : December 22, 1992

INVENTOR(S) : Robert C. Kane

It is certified that error appears in the above-indentified patent and that said Letters Patent is hereby corrected as shown below:

Column 6, Claim 3, lines 37-38: Delete "electrons by the first electrode"

Insert "electrons emitted by the first electrode".

Signed and Sealed this

Eleventh Day of October, 1994

*Attest:*

Bruce Lehman

BRUCE LEHMAN

*Attesting Officer*

*Commissioner of Patents and Trademarks*